United States Patent [19]

Johnson

[11] Patent Number: 4,653,269

[45] Date of Patent: Mar. 31, 1987

[54] HEAT ENGINE

[76] Inventor: David E. Johnson, 5370 Cramer Rd., Canandaigua, N.Y. 14424

[21] Appl. No.: 795,709

[22] Filed: Nov. 6, 1985

Related U.S. Application Data

[63] Continuation of Ser. No. 459,301, Jan. 18, 1983, abandoned, which is a continuation-in-part of Ser. No. 188,573, Sep. 18, 1980, Pat. No. 4,369,623, which is a continuation of Ser. No. 863,858, Dec. 20, 1977, abandoned, which is a continuation of Ser. No. 710,092, Jul. 30, 1976, abandoned, which is a continuation of Ser. No. 558,371, Mar. 14, 1975, abandoned.

[51] Int. Cl.[4] ..... F02G 3/02

[52] U.S. Cl. ..... 60/39.63; 60/39.2; 60/627; 60/727

[58] Field of Search ..... 60/39.2, 39.6, 39.63, 60/39.163, 625, 626, 627, 628, 727, 415, 641.14

[56] References Cited

U.S. PATENT DOCUMENTS

| | | | |
|---|---|---|---|
| 1,847,260 | 3/1932 | Pardee | 60/39.63 X |
| 3,037,348 | 6/1962 | Gassmann | 60/39.163 |
| 3,203,167 | 8/1965 | Green | 60/641.14 |
| 3,280,554 | 10/1966 | Knowles | 60/39.163 |
| 3,426,523 | 2/1969 | Straub | 60/626 X |
| 3,546,879 | 12/1970 | Hass | 60/39.163 |
| 3,577,729 | 5/1971 | Warren | 60/39.63 |

FOREIGN PATENT DOCUMENTS

| | | | |
|---|---|---|---|
| 2020367 | 11/1979 | United Kingdom | 60/727 |

*Primary Examiner*—Michael Koczo

*Attorney, Agent, or Firm*—Browdy and Neimark

[57] ABSTRACT

A heat engine with a compressor, an external combustion chamber from which combustion gases pass through suitable valving to an expander, an air compressor, a heat exchanger where exhaust gases from the expander preheat compressed air which then flows to the combustion chamber, and an accumulator for storing unneeded compressed air from the compressor. The system also has the capability of regenerative braking, i.e. slowing of the engine by employing it as a compressor to compress air which is passed to the accumulator.

20 Claims, 4 Drawing Figures

HEAT ENGINE

CROSS REFERENCE TO RELATED APPLICATIONS

This application is a continuation of U.S. Ser. No. 459,301, filed Jan. 18, 1983, abandoned, which is a continuation-in-part of copending application Ser. No. 188,573 filed Sept. 18, 1980, now issued as U.S. Pat. No. 4,369,623 by the same inventor; the entire teaching of which is hereby incorporated by reference as if set forth herein in full. Application Ser. No. 188,573 was a continuation application of Ser. No. 863,858, filed Dec. 20, 1977, abandoned; which was, in turn, a continuation of application Ser. No. 710,092, filed July 30, 1976, abandoned; and which latter was, in turn, a continuation of application Ser. No. 558,371, filed Mar. 14, 1975, abandoned.

BACKGROUND OF THE INVENTION

The present invention relates to heat engines and more particularly, to a novel engine in which the combustion chamber is separated from the expander which receives hot gases from the combustion chamber.

The engines of the invention are thermodynamically similar to the gas turbine, and can utilize one or more pistons or other displacement devices for compression and expansion. Combustion is external of the displacement devices, thereby providing many advantages. The use of a combustion chamber separated from the displacement devices provides greater flexibility as to fuels used. Thus, solid, liquid or gaseous fuel may be utilized. The combustion temperature may be lower and the combustion time longer, resulting in more complete combustion, to thereby substantially reduce the level of pollutants in the exhaust. In addition, no critical ignition timing is necessary in such an arrangement.

One or more devices, or a portion of the operating cycle of the device, is utilized to compress air which is passed through a heat exchanger to be preheated while cooling exhaust gases and which is then introduced into the combustion chamber. Excess compressed air may be stored in an accumulator for subsequent use when necessary, for example, during periods of peak power demand or when the engine is cold.

During braking, regenerative braking may be achieved whereby the engine is slowed while compressing air in the compressor which is passed to an accumulator for storage and subsequent use when needed. The compressor may be disconnected on start-up so that there is very low starting load. The stored compressed air is also available for powering auxiliary equipment as well as for meeting peak power demands and for engine start-up. The availability of compressed air for start-up provides easy cold weather starting and if desired enables the fuel to be cut off completely on idle since the engine can be restarted immediately on demand in view of the availability of compressed air which can be passed through the system to the expanders.

The engines of the invention may in appropriate sizes be employed in a wide variety of applications. For example, when employed to power an automobile, the engines of the invention would have increased efficiency, reduced exhaust levels of pollutants and heat, fast starting capability, compressed air availability, dynamic braking, and instant power availability. For buses and trucks, the saving of braking energy would be a particularly significant factor. The engines of the invention would also find application in locomotives, stationary power plants, marine engines and airplanes. A primary advantage of use in aviation would be high horsepower availability for the size of the engine during take-off because of the availability of the stored compressed air for use as a take-off assist.

Another advantage of the invention resides in its great versatility, engines can be made with virtually any number (even or odd) of cylinders, and a wide range of compressor/expander ratios (from 1:1.5 to 1:10 or about 5) can be used. The invention can also be embodied in a turbine form.

The above and other objects, features and advantages of the invention will become more apparent as this description proceeds.

DETAILED DESCRIPTION OF THE INVENTION

Figure 1:
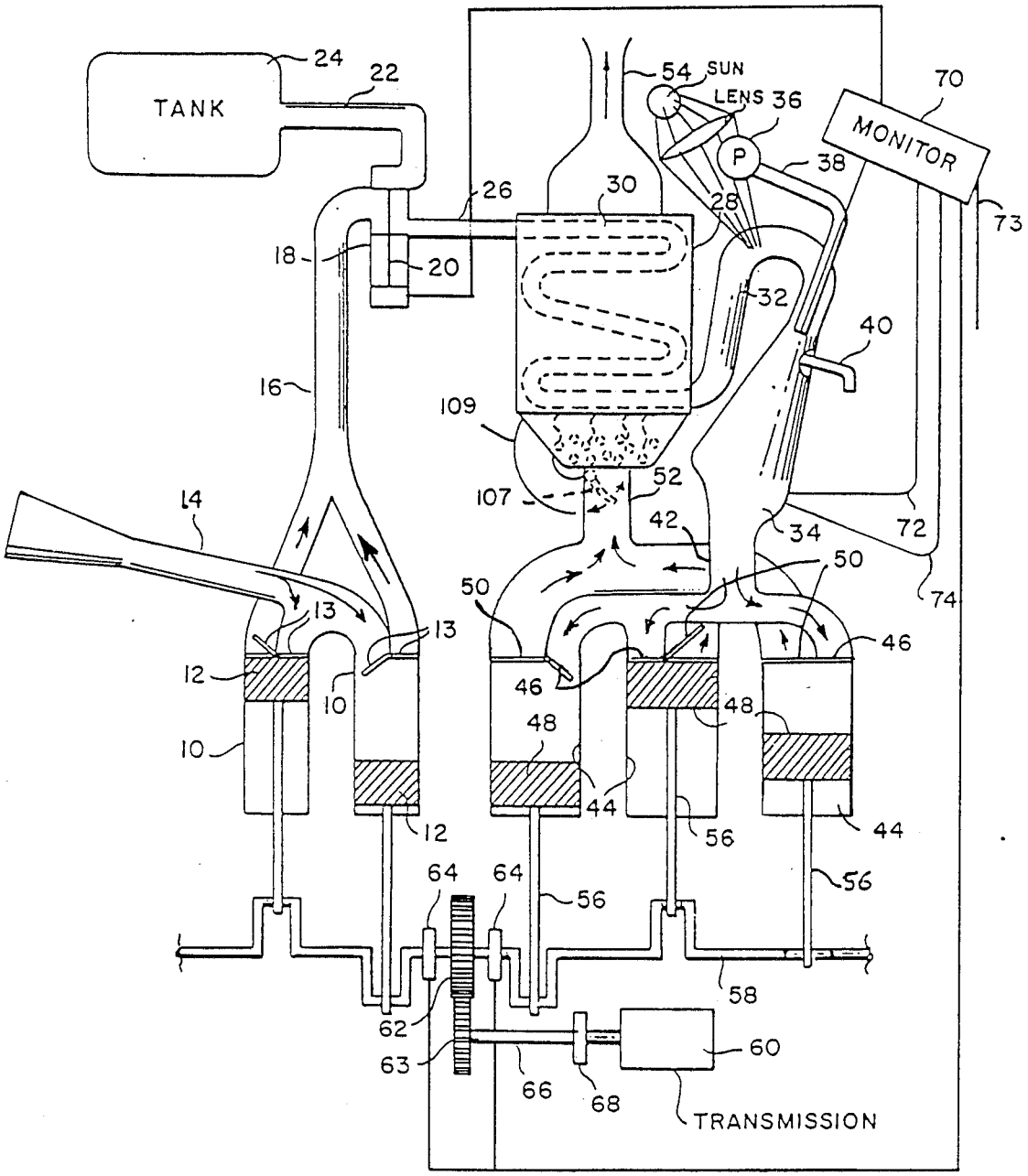
FIG. 1 is a diagrammatic view of a presently preferred embodiments of the invention in which different pistons form the air compressor and the power unit.

Referring now to FIG. 1, where a preferred embodiment of the invention is illustrated, the system of the invention includes an air compressor comprising a pair of cylinders 10 in which there are pistons 12. Air is drawn into the cylinders from an air inlet duct 14 into a cylinder in which the piston is in the retracted position which in the illustrated embodiment is the right hand cylinder 10. On the upstroke, air is compressed and forced into air supply duct 16. Suitable reed or poppet valves 13 are provided both at the intake and exhaust openings of cylinders 10 to permit the extrance of fresh air and the discharge of compressed air at the appropriate times in the cycle of movement of pistons 12. The compressed air is then passed through a valve 18 which has a sliding spool member 20 which permits the compressed air to be passed: (a) through duct 22 into an accumulator tank 24 where compressed air is stored and (b) into a duct 26 which leads to an air preheater 28. Valve 18 controls the diversion of the comressed air into a portion of the air which flows to accumulator 24 and the remainder to the air preheater 28.

In the preheater 28 the air is heated by the heat in the exhaust gases by a heat exchanger coil 30. Heated air leaves the preheater through line 32 and enters into the upper end of an external combustion chamber 34. In the illustrated embodiment, a fuel pump 36 pumps any suitable fuel such as a liquid fuel, gaseous or a solid fuel through fuel inlet line 38 into the combustion chamber where the fuel is ignited by a conventional suitable ignition means 40. By relatively simple modifications, any liquid or gaseous fuel may be burned in the combustion chamber. The resulting hot combustion gases, which may be at a temperature on the order of 2000° F. and are now at elevated pressure, pass out duct 42 at the lower end of the combustion chamber through cam operated valves 46. The valves are designed to be opened approximately 40° of rotation of the crank for running in the cases of valve 46 and valve 130 in FIG. 2, to allow the high pressure gases into piston chamber 44 and to force one of the pistons 48 downwardly on the power stroke. When the piston reaches the bottom of its stroke, an exhaust valve 50 opens to allow the spent gas to exit via passageway 52, around heat exchange coil 30 in the air preheater, and then out exhaust duct 54.

Figure 3:
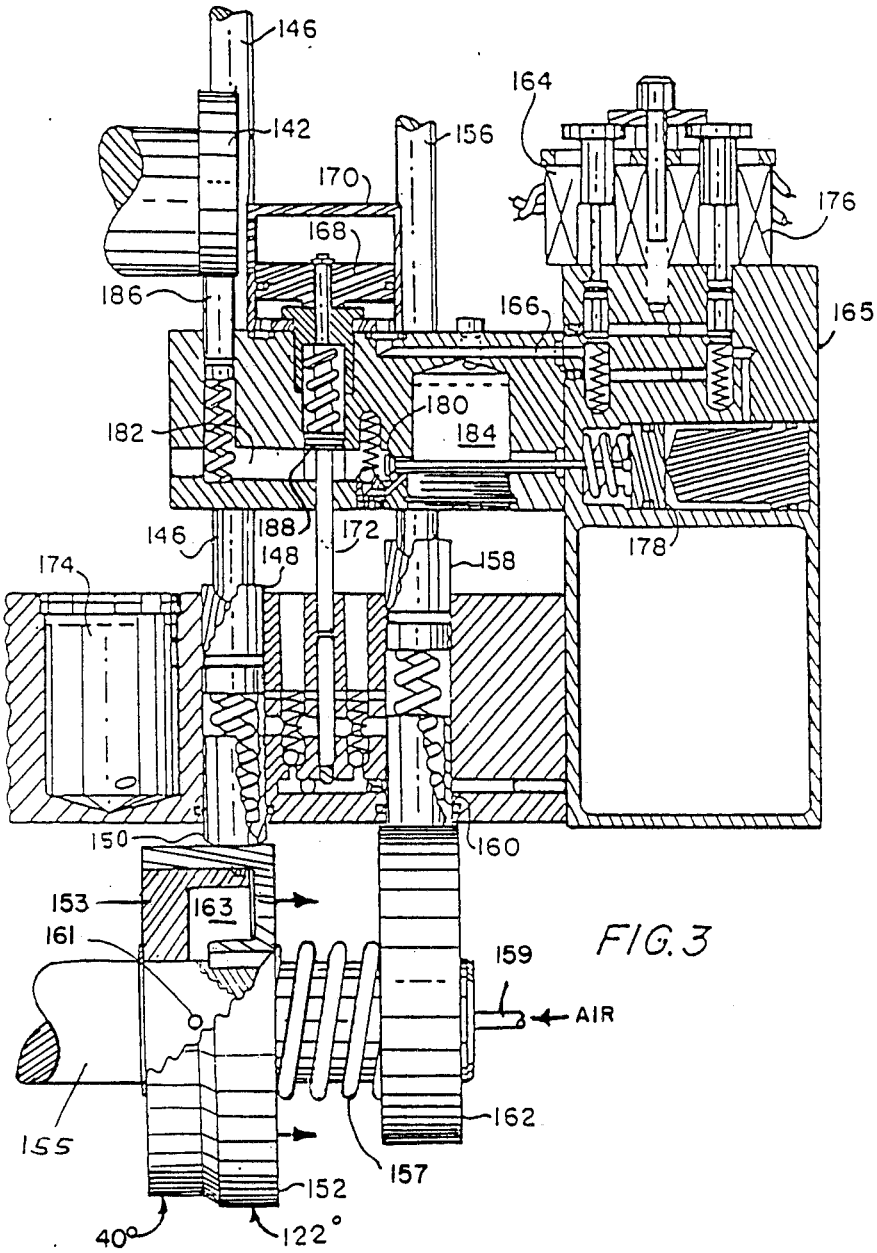
FIG. 3 is an enlarged view of part of the apparatus of FIG. 2 showing the control means in greater detail.

In the embodiment shown, and as illustrated in FIG. 3 and described more in detail below, the cams provide for one amount of dwell for running, and another different amount of dwell for starting. In order to be self-starting, the invention requires three power pistons at the minimum, but any larger number is also possible for different specific embodiments of the invention. In order to determine the amount of dwell necessary for differing numbers of power pistons, one divides 360 by the number of pistons, and then adds a small number of degress, two degrees presently being preferred, in order to assure that the valves will overlap in operation. Further, as mentioned above, about 40 degrees of dwell for the running mode is required for each cylinder regardless of the number of cylinders in the engine. However, this amount can be varied if needed, as is known to those skilled in the engine arts.

Pistons 48 are mounted on piston rods 56 which are connected to a crankshaft 58. The crankshaft is connected to the vehicle or other transmission or other power take-off means schematically indicated by reference numeral 60 via a suitable gearing system including pairs of gears 62, 63, pneumatic clutches 64 and a clutch 68 in engagement via a shaft 66 connected to transmission 60. Pistons 12 of the air compressor are also connected to the crankshaft 58. By disengagement of the appropriate one of the clutches 64, it is possible to inactivate the expansion cylinders 44, for example, during braking or idling, or alternatively, to deactivate the air compressor, for example, at times of peak power output such as when accelerating.

Operation of the engine is regulated by suitable control means diagrammatically illustrated as including a control monitor 70 which receives input signals such as a signal indicative of the pressure in the combustion chamber via line 72 and an indication of the temperature of the gases going to the expansion cylinders from the combustion chamber via temperature sensor line 74. In addition, monitor 70 receives an input 73 from the action of the driver or operator, for example, when depressing the accelerator pedal or brake pedal. Monitor 70 is also connected to the fuel pump 36 to appropriately adjust the flow of fuel to the combustion chamber, and to the spool valve 20. The monitor 70 could include a small computer for the control operations.

The monitor also controls the pneumatic clutches 64 as a function of engine operating temperature and pressure, as well as the valve 18.

In operation, there are three primary operating modes: (1) steady state mode, (2) a regenerative braking mode, and (3) a peak power mode. In the steady state mode, which the description has been primarily directed to up to this point, air is drawn into the compressor 10 and compressed air is forced by pistons 12 through duct 16, valve 18, and air preheater 28 into combustion chamber 34. In combustion chamber 34, fuel is ignited and the resulting hot combustion gases develop the operating pressure of the engine. The high pressure gases now pass into expansion cylinders 44 and give up energy which is transmitted via crankshaft 58 and the associated structure to transmission 60 to drive a vehicle, or other end use. After the expansion stroke, the spent combustion gases pass through the air preheater 28 where additional energy in the form of heat is reclaimed to preheat the air going to the combustion chamber.

In the regenerative braking mode, each revolution of the engine driven by inertia, for example, of a fly wheel, delivers one volume of compressed air from compressor 10 through valve 18 whose spool member 20 is now in a position blocking flow of air into duct 26 and permitting the air to flow only through duct 22 into the accumulator 24. At this time, the right side clutch 64 is disengaged due to a lowering of pressure in the combustion chamber whereby the expansion cylinders are mechanically and pneumatically disconnected from the compressor. The compressed air which is being stored in the accumulator 24 is then available for future use.

As the vehicle comes to a stop, if desired, the pneumatic clutch may be re-engaged rather than stall the engine and spool valve 20 shifted to a position which will permit a low level of compressed air to pass through the system to cylinders 44 in an amount sufficient to keep the engine turning over. When the operator starts the car up from a stop, or when the peak power mode is otherwise demanded, as for example for passing, depression of the accelerator pedal will further shift valve 20 to permit the flow of a greater amount of compressed air to the combustion chamber. In the event that the operator desires peak power mode operation, for example, when quickly starting after a stop or in passing another vehicle, the left side clutch 64 may be disengaged thereby disengaging the compressor 10 from the expansion cylinders. The absence of the compressor torque drain during this mode provides a large power output even for a small bore engine for a short duration. In this mode, the valve 20 shifts to a middle position which permits free passage of stored compressed air in accumulator 24 through air preheater 28 and into combustion chamber 34.

Figure 2:
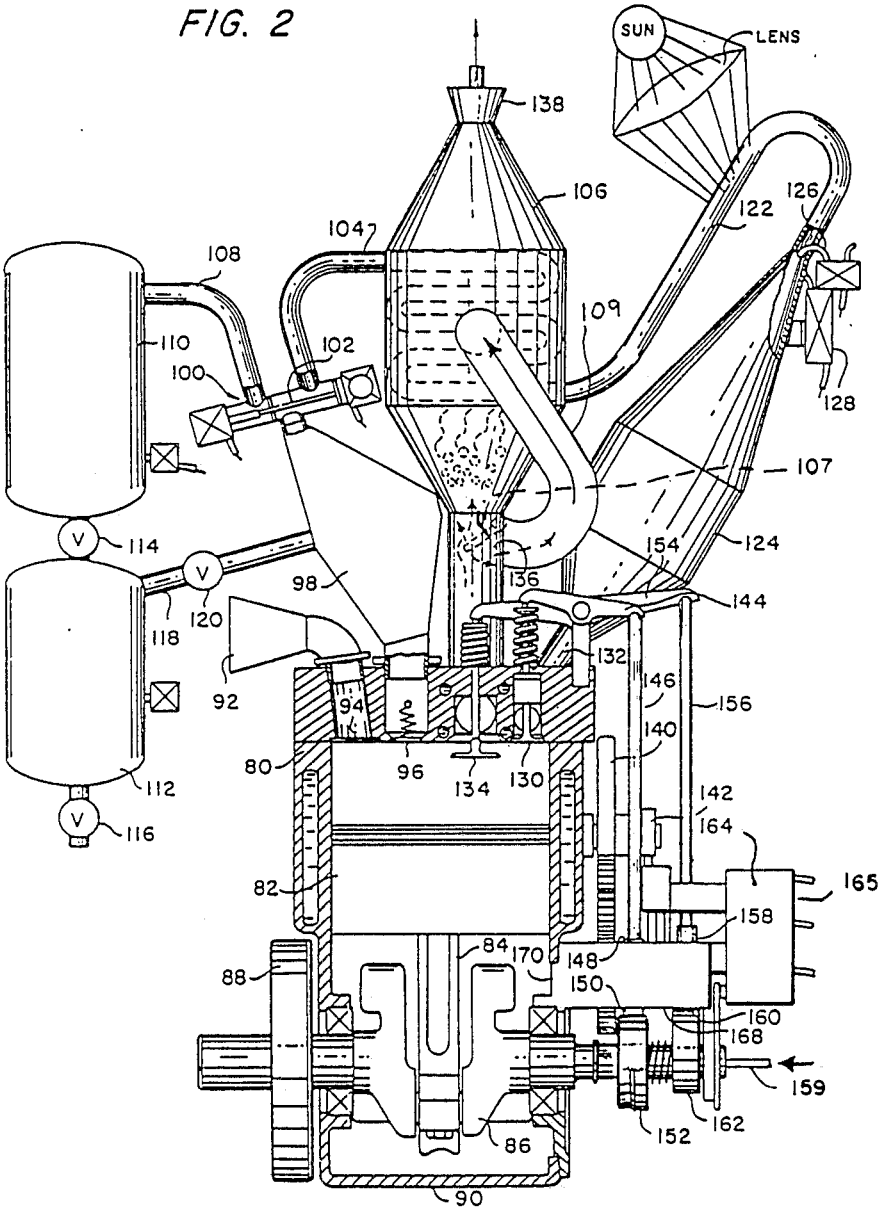
FIG. 2 is a diagrammatic view of another embodiment of the present invention in which the same pistons compress the air and function as a compressor during one stroke of the cycle and during the other strokes are driven by the hot gases from the combustion chamber.

FIG. 2 illustrates another embodiment of the invention in which air compression takes place in the displacement chambers during one stroke of the pistons and the remaining strokes of the cycle are expansion strokes in which high pressure combustion gases drive the pistons. To simplify the illustration, a single piston cylinder 80 is disclosed and it will be understood that for most applications, such as in vehicles, a plurality of such cylinders will be employed, as is customary.

A piston 82 reciprocates within cylinder 80 and has a piston rod 84 which is connected to a crankshaft 86 which has a fly wheel 88 at one end. A housing 90 encloses the crankshaft and the bottom of the housing may function as an oil sump.

During the air compression stage, fresh air enters the cylinder through intake 92 and a suitable valve such as a reed valve 94 due to the descending piston lowering the cylinder pressure and opening valve 94. On its return stroke, piston 82 compresses the air, closes inlet valve 94 and forces the compressed air out through a spring biased discharge valve 96 to a surge tank 98 and then into a three-way valve 100 which has a sliding spool 102. Valve 100 is comparable to the valve 18 of the FIG. 1 embodiment and performs in the same fashion. With spool member 102 in the middle position, air passes through valve 100 into line 104 to the air preheater 106 for indirect heat exchange with spent gases going to exhaust. When the spool member 102 is moved to its extreme left position, the air passes solely through line 108 to an accumulator 110. This would be the position of the valve during regenerative braking. In this embodiment there is an additional accumulator or air reserve tank 112 in communication with accumulator 110 through a one-way check valve 114. When the pressure in accumulator 110 reaches a given level, valve 114 opens and the pressurized air flows into reserve tank 112 which has a relief valve 116 for safety purposes. Air from reserve tank 112 may be passed through line 118 and a valve 120 into the surge tank 98 when needed. In this fashion, the system would always have sufficient air to start the engine when it is cold.

When valve 100 is in a middle position, the flow of air from the surge tank is divided into two streams, part of the air flowing to accumulator 110 and the remainder to the air preheater 106.

The preheated air from air preheater 106 passes through conduit 122 into the upper end of a combustion chamber 124 which is comparable to the combustion chamber 34 of the FIG. 1 embodiment. The air enters the combustion chamber concentrically around a fuel nozzle 126 which discharges fuel into the combustion chamber 124 for ignition by an igniter 128. The high temperature and pressure combustion gases enter the cylinder 80 upon the opening of an expander intake valve 130 which receives the combustion gases from discharge conduit 132 of the combustion chamber. The high pressure gases push piston 82 downwardly,rotating the crankshaft to provide useful output power, such as for propelling a vehicle. When crankshaft 86 has rotated about 40° from the top dead center, valve 130 closes and at the bottom dead center exhaust valve 134 is opened so that the spent gases are discharged through line 136 through the air preheater to exhaust duct 138.

A timing belt 140 or other suitable control mechanism is used to turn an actuating cam 142 at, for example, about 5:1 or other selected engine compression/expansion ratio. This cam and related valves 100, 130 and 134 operating via suitable control means, will place the engine into normal operation, regenerative braking or peak power mode in a manner analogous to that explained above as to FIG. 1.

The invention is capable of a large variety of compression/expansion ratios, the 5:1 ratio described above is by way of example only. As is well known in thermodynamics and the engine arts, changing the ratio will have an effect on the operating temperatures, the materials used, and the efficiency of the engine. By simply changing all of the suitable gears, pulleys, belts or other control means, the invention teaching can be accommodated in any of the kinds of engines in which it is useful (piston, turbine, screw or other types) and depending upon materials, fuel used, ambient temperature, operating temperature, and the like, different ratios can be used. Overall,in all of these different combinations, ratios in the range of 1:1.5 to 1:10 could be used. It is thought that, at the present state of the art, ratios higher than 1:10 are not practical since the operating temperatures would be too demanding of the materials and of the engine itself.

The opening and closing of expansion inlet valve 130 is regulated by a two-armed lever 144, a rod 146 which has its lower end disposed in a recess in block 148 connected to a cam follower 150 associated with a cam 152 on crankshaft 86. When cam 152 is in the position as shown, rod 146 is depressed and via the two-armed lever 144, valve 130 is closed. When a high point on the cam 152 is in contact with cam follower 150, rod 146 is elevated causing the valve 130 to open.

Actuation of the discharge valve 134 is accomplished in a similar fashion via a two-armed lever 154, rod 156, lifter 158, cam follower 160, and cam 162 on the crankshaft.

In order for the engine shown in FIG. 2 to be self-starting, as explained above, three such cylinders will be needed. In such an engine having three cylinders of the type shown in FIG. 2, only some of the components need be duplicated for each cylinder, and many of the components will be in common to serve all of the cylinders in the engine. Among the common components may be the combustion chamber 124, the accumulator means, the heat exchanger, the controller 165, and much of the valving and other secondary pieces of apparatus, all as will be evident to those skilled in the engine arts. This will include any manifolding of different flows through the engine as is common with multi-cylinder engines.

During a regenerative braking cycle of operation, in addition to the flow of fuel being interrupted, valves 130 and 134 are inactivated. This inactivation is accomplished via a solenoid valve 164 which, when in a down position, permits high pressure air to pass through line 166 (see FIG. 3) from a suitable source, for example, the accumulator, and elevates piston 168 in an air cylinder 170. Elevation of the piston 168 of a control rod 172 attached thereto cancels the action of cams 152 and 162 by inactivating the pneumatic system associated with the cams since elevation of rod 172 opens a return passage to oil reservoir 174. Thus, elevation of cam followers 150 and 160 by cams 152 and 162 is not effective to elevate the valve lifters for rod 146 leading to inlet valve 130 or for 156 leading to exhaust valve 134.

At the same time, by a suitable control mechanism, which might include the air cylinder 170, spool member 102 of valve 100 is shifted to the extreme right position so that the surge tank 98 communicates only with accumulator 110. Now on the down stroke of the piston, air is sucked through intake 92 and valve 94, compressed as the piston moves up, and the compressed air is forced through valve 96 and surge tank 98 into accumulator 110 and, if necessary, into reserve tank 112.

At the conclusion of the braking mode, when the engine is restarted, the stored compressed air leaves accumulator 110 through valve 100 which has now moved to a position permitting this flow, and eventually into cylinder 80 through power inlet valve 130. Thus, the engine may be restarted although it was not idling. If the engine had three cylinders or more, there would not be a dead spot in the engine and therefore this high pressure air would cause the engine to function as an air motor and start up without idling. The present engine is a very low emission engine since fuel loss during idling is substantially reduced and may be completely eliminated if the flow of fuel ceases completely when fuel is not needed. Such fuel cut-off can be readily accomplished as needed by those skilled in the engine arts.

The starting apparatus is shown in the lower portion of FIG. 3. High pressure air is inlet through conduit 159, and acts on the movable part 152 of the two level cam. The left hand side 153 is fixed to the shaft 155, by means not shown, and the high pressure air from conduit 159 enters into a space 163 between the two cam portions 152 and 153 via an orifice 161 formed through the shaft. A compression spring 157 normally urges the movable cam portion 152 to the left, towards the fixed cam portion 153. Suitable rotating seals, sliding seals, and the like are provided wherever needed, as is well known to those skilled in the engine arts. Thus, for starting, no air is provided through the conduit 159, and the spring 157 will urge the starting 122° degree dwell time cam 152 under the cam follower 150. After starting is accomplished, the control means will provide air through the conduit 159, and the sliding cam portion 152 will be forced to the right against the pressure of the spring 157. This will bring the left hand part of the outer cam shell, the part marked 40° in the drawing, under the cam follower 150, and the engine will be in the "run" mode, as opposed to the starting mode.

In the full power mode of operation, a solenoid valve 176 is employed to cancel the action of cam 142 so that there is no compression. This may be accomplished in various ways, for example, depression of the solenoid valve 176 may cause flow of air against the face of an air cylinder 178 moving valve 180 to an open position so that oil in chamber 182 may return to oil reservoir 184. Since hydraulic pressure is not maintained in chamber 182, depression of cam follower 186 associated with cam 142 does not result in hydraulic pressure being applied against piston 188 associated with rod 172.

In normal operation, for a one cylinder engine or for each cylinder of a multi-cylinder engine, cam 142 rotating at about one-fifth or other selected ratio with respect to engine expander/compressor ratio is effective through depression of cam follower 186 and the hydraulic fluid acting upon the piston to cancel the action of the valve lifters associated with rods 146 and 156 in time as needed with respect to operation of the cams since elevation of the rod 172 permits oil to return to reservoir 174.

Figure 4:
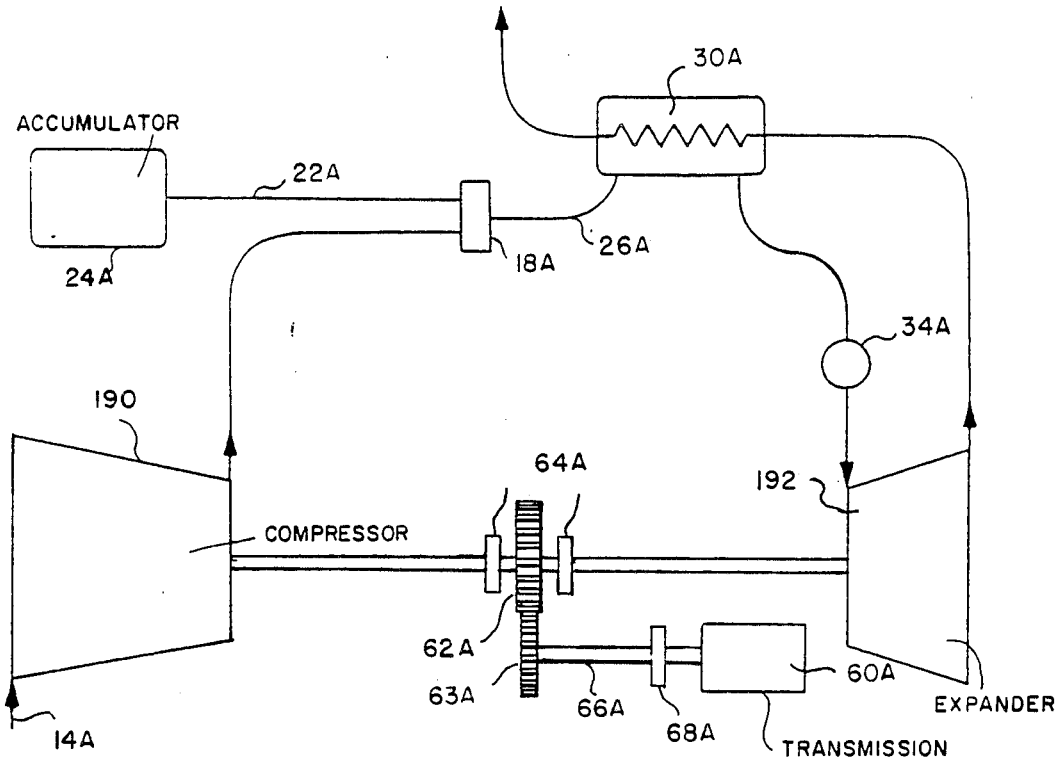
FIG. 4 is a highly schematic showing of the invention as embodied using turbines as the displacement devices.

Referring now to FIG. 4, there is shown an embodiment wherein the invention teaching has been applied to an engine operating using turbines. Parts the same as or closely similar to parts already described above in regards to FIG. 1 are indicated by the same reference numeral and an "a". The basic difference is that a turbine compressor 190 is the displacement device, and another turbine 192 is used as the power or expander device. The full teaching of the invention including the accumulator 24*a*, the valving 18*a*, the heat exchanger 30*a*, the external combustion chamber 34*a*, and especially the clutches 64*a*, are used in this turbine based embodiment of FIG. 4, in common with the other embodiments described above in regard to FIGS. 1, 2 and 3.

The turbine form of the invention is deemed to have particular advantages and utility in automotive use, since by suitable operation of the clutches 64, the expander or power turbine 192 can be isolated from the load imposed by the compressor turbine, which is particularly advantageous when the invention is used in the power mode, as described above. This provides a significant step forward for the present invention in its turbine mode, as compared to conventional turbine engines used in automobiles. Such conventional turbine engines are chronically sluggish in automotive use. By disconnecting the compressor 190 for power operation, this sluggish performance disadvantage of the prior art is overcome.

In addition to turbines, as is now clear , other sorts of fluid displacement devices could be used in place of turbines or pistons as illustrated, for example, gears, screws, vanes, bellows, diaphragms, and the like, and combination of such devices in one engine, are all deemed possible, as can be engineered by those skilled in the engine arts using the teachings of the invention.

As another embodiment,the combustion may be external of the power fluid circuit. In such a case, a combustion chamber could be located in the bottom of the air heater in lieu of where it is illustrated in FIGS. 1 and 2. The power fluid would be pressurized air, and the spent power fluid would be the oxidizer for the combustion chamber. The power fluid would be heated and pressurized by indirect rather than direct heat exchange.

In similar fashion, the air from the air heater could be further heated and pressurized to obtain the power fluid by radiant heat from the sun acting on the air while in line 32 of FIG. 1 or conduit 122 of FIG. 2, as schematically indicated thereon.

Thus, it will be observed that this engine can be operated either as an I.C. (internal combustion—internal to the power fluid circuit) or E.C. (external). If the engine is operated as an E.C., the exhaust from the power cylinder(s) is free from the products of combustion and may be used as the oxidizer for combustion of the fuel (solid, liquid or gas—any fuel that would leave a residue or harmful ash inside the engine will be burned externally). A shutter or throttle valve 107 would direct the hot exhaust air through or around the burning fuel as needed, using a by-pass pipe 109, as needed. For solid fuel, particle size would determine fire response time, as is known.

The ability to burn solid fuel particles (saw dust, pulverized straw, hay etc.) makes engines of the invention attractive as a power plant for farm tractors, etc. Solar radiation heating, as a source or in addition for preheating, is another available option for these engines and could be directed at the conduit between the preheater and power cylinder (FIGS. 1 and 2).

While the invention has been described in detail above, it is to be understood that this detailed description is by way of example only, and the protection granted is to be limited only within the spirit of the invention and the scope of the following claims.

What is claimed is:

1. An engine, comprising:

compression means for generating a first compressed fluid, expansion means communicating with said compression means, combustion means externally located with respect to said compression means and said expansion means, accumulator means for storing at least some of said first fluid including means for selectively directing said first fluid from said accumulator means to said combustion means, said combustion means defining means for converting said first fluid to a second power fluid, means to supply said power fluid from said external combustion means to said expansion means, power take-off means, coupling means selectively interconnecting said power take-off means, said expansion means and said compression means to each other, said coupling means comprising clutch means for independently connecting and disconnecting said compression means and said expansion means to each other and to said power take-off means via said coupling means, and means for selectively operating said engine in one of a first steady-state mode in which all of said expansion means, said compression means and said power take-off means are engaged together, a second regenerative braking mode in which said expansion means are disconnected from said compression means and said power take-off means by said clutch means, and a peak power mode wherein said compression means are disconnected from said expansion means and from said power take-off means by said clutch means, said directing means becoming operative in said peak power mode, said means for selectively operating said engine including means for sensing internal operational parameters generated within the engine and external operational parameters applied from outside the engine, the selection of one of said first steady-state mode, said second regenerative braking mode or said peak power mode being determined as a function of said internal and external operational parameters.

2. The combination of claim 1, wherein said compression means comprises turbine means.

3. The combination of claim 1, wherein said expansion means comprises turbine means.

4. The combination of claim 1, wherein both said expansion means and said compression means comprise turbine means.

5. The combination of claim 1, wherein said compression means comprises at least one piston and cylinder means.

6. The combination of claim 1, said expansion means comprising at least one cylinder and piston arrangement.

7. The combination of claim 6, said expansion means comprising at least three cylinder and piston means, said engine comprising crankshaft means interconnecting the pistons of said at least three piston and cylinder means, and said crankshaft means and said arrangement of said pistons about said crankshaft means constituting means for self-starting said engine upon application of said power fluid to said piston means.

8. The combination of claim 1, said compression means and said expansion means both comprising cylinder and piston means.

9. The combination of claim 1, and means for utilizing solar energy in combination with said combustion means to add heat to said power fluid.

10. The combination of claim 1, said engine having an expansion/compression ratio substantially in the range of from 1.5:1 to 10:1.

11. The combination of claim 10, wherein said expansion/compression ratio is substantially 5:1.

12. The engine of claim 1, wherein said internal parameters include engine pressure, engine temperature and fuel feed rate, and said external parameters include operator controlled braking demands.

13. An engine, comprising:

compression means;

expansion means communicating with said compression means;

combustion means externally located with respect to said compression means and said expansion means for creating power fluid;

means to supply said power fluid from said external combustion means to said expansion means;

power take-off means;

coupling means selectively interconnecting said power take-off means, said expansion means and said compression means to each other, said coupling means comprising clutch means for independently connecting and disconnecting said compression means and said expansion means to each other and to said power take-off means via said coupling means;

and means for selectively operating said engine in one of a steady-state mode wherein all of said expansion means, said compression means and said power take-off means are engaged together, a regenerative braking second mode wherein said expansion means are disconnected from said compression means and said power take-off means by said clutch means, and a peak power third mode wherein said compression means are disconnected from said expansion means and from said power take-off means by said clutch means;

said means for selectively operating said engine including means for sensing internal operational parameters generated within the engine and external operational parameters applied from outside the engine, the selection of one of said steady-state mode, said regenerative braking second mode or said peak power third mode being determined as a function of said internal and external operational parameters, said expansion means comprising at least three cylinder means, each cylinder means including a piston and at least one valve, said engine comprising a crank-shaft interconnecting the pistons of said at least three cylinder means, and said pistons being arranged on said crank-shaft to facilitate self-starting of said engine upon the application of said power fluid to said pistons, said engine further having control means, including cam means, for causing said at least three cylinder means to operate in a first dwell period, and said cam means being operable in a second position wherein said cam means operate said valves in said three cylinder means for a different dwell time necessary for a running mode.

14. The combination of claim 13, wherein said engine includes valve means for each of said piston means, and said control means include means for operating said valve means, said control means including cam means comprising two stage cam means operable in said first position to run the engine at said first dwell period and operative to permit starting of said engine at a different dwell period defined by said two-stage cam means.

15. The combination of claim 14, wherein said engine includes three piston means and said starting dwell time is greater than 120 for said engine.

16. The combination of claim 14, wherein said starting dwell $D=360^\circ$ Np, np=number of piston means, is adjusted by at least two degrees for overlap.

17. The combination of claim 14, each said two-stage cam means comprising a cam follower, a shaft having a first cam portion fixed thereto, a second cam portion slidably mounted with respect to said first cam portion and having its outer surface engaged with said cam follower, spring means urging said second cam portion to said different dwell period for starting, and pneumatic means for moving said second cam portion to said first position against the pressure of said spring means to cause said cam follower to operate in said first dwell period for running.

18. The engine of claim 13, wherein said internal parameters include engine pressure, engine temperature and fuel feed rate, and said external parameters include operator controlled braking demands.

19. An engine, comprising:

compression means;

expansion means communicating with said compression means;

combustion means externally located with respect to said compression means and said expansion means for creating power fluid;

means to supply said power fluid from said external combustion means to said expansion means;

power take-off means;

coupling means selectively interconnecting said power take-off means, said expansion means and said compression means to each other, said coupling means comprising clutch means for independently connecting and disconnecting said compression means and said expansion means to each other and to said power take-off means via said coupling means;

and means for selectively operating said engine in one of a steady-state first mode wherein all of said expansion means, said compression means and said power take-off means are engaged together, a regenerative braking second mode wherein said expansion means are disconnected from said compression means and said power take-off means by said clutch means, and a peak power third mode wherein said compression means are disconnected from said expansion means and from said power take-off means by said clutch means, said means for selectively operating said engine including means for sensing internal operational parameters generated within the engine and external operational parameters applied from outside the engine, the selection of one of said steady-state first mode, said regenerative braking second mode or said peak power third mode being determined as a function of said internal and external operational parameters, said power take-off means comprising a first gear interposed between said compression means and said expansion means, and said clutch means including first and second clutches positioned one on either side of said first gear and selectively interconnecting said first gear with said expansion means and said compression means, a second gear in mesh with said first gear, power transmission means, and power clutch means interconnecting said second gear with said power transmission means;

whereby by deactivation of said power clutch means and activation of both of said first and second clutches on both sides of said first gear, said expansion means and said compression means can be connected together and isolated from said transmission means to permit said engine to idle.

20. The engine of claim 19, wherein said internal parameters include engine pressure, engine temperature and fuel feed rate, and said external parameters include operator controlled braking demands.

* * * * *